United States Patent [19]

Strong

[11] 4,077,226

[45] Mar. 7, 1978

[54] CRYOGENIC FREEZER

[75] Inventor: William K. Strong, Solvang, Calif.

[73] Assignee: Restaurant Technology, Inc., Oak Brook, Ill.

[21] Appl. No.: 702,442

[22] Filed: Jul. 6, 1976

[51] Int. Cl.[2] ..... F25D 13/06

[52] U.S. Cl. ..... 62/63; 62/374; 62/380

[58] Field of Search ..... 62/63, 266, 345, 373, 62/374, 375, 378, 380

[56] References Cited

U.S. PATENT DOCUMENTS

| | | | |
|---|---|---|---|
| 2,286,225 | 6/1942 | Noyes | 62/380 |
| 3,282,067 | 11/1966 | Dreksler | 62/380 |
| 3,376.710 | 4/1968 | Hirtensteiner | 62/380 |
| 3,398,788 | 8/1968 | Brunson | 62/380 |
| 3,403,527 | 10/1968 | Berreth et al. | 62/380 |
| 3,455,120 | 7/1969 | Schlemmer | 62/380 |
| 3,494,140 | 2/1970 | Harper et al. | 62/374 |

FOREIGN PATENT DOCUMENTS

| | | | |
|---|---|---|---|
| 6,812,500 | 3/1970 | Netherlands | 62/380 |

*Primary Examiner*—Ronald C. Capossela
*Attorney, Agent, or Firm*—Dressler, Goldsmith, Clement, Gordon & Shore, Ltd.

[57] ABSTRACT

An isothermal cryogenic freezer tunnel for supplying cryogenic gas to the food to be frozen at a temperature which is substantially uniform along a major portion of the length of the freezer tunnel. The freezer tunnel is equipped with an overhead duct having downwardly-directing flow apertures. A foraminous conveyor is located below the duct for accommodating the conveyorized passage of food through the tunnel. Spray nozzle means are mounted in the tunnel adjacent the inlet of the duct for ejecting cryogenic gas into the tunnel. The tunnel further includes fans positioned in vertical alignment with the flow apertures for propelling the gas through the duct onto the conveyorized food where the gas at a substantially constant temperature, blankets, impinges and freezes the food.

22 Claims, 7 Drawing Figures

FIG. 1
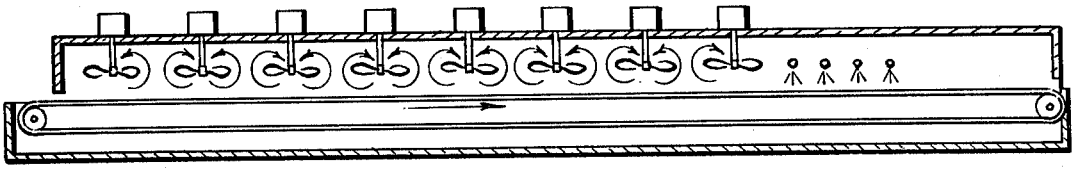
-20°F -60°F -100°F -140°F -170°F -200°F
PRIOR ART TYPICAL TEMPERATURES
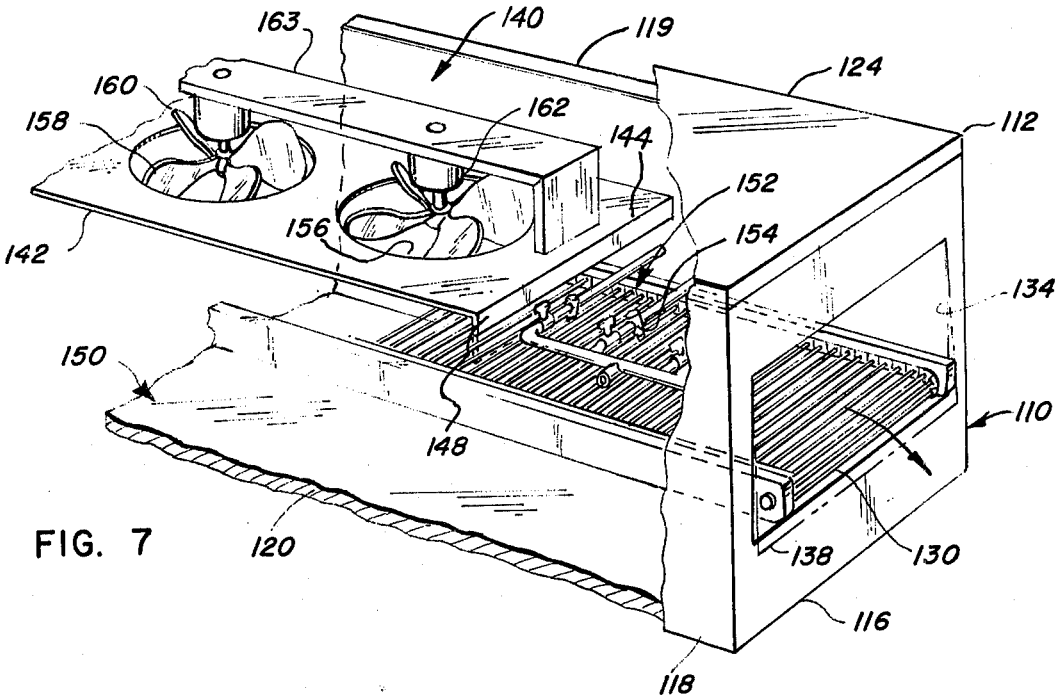
FIG. 7
FIG. 2
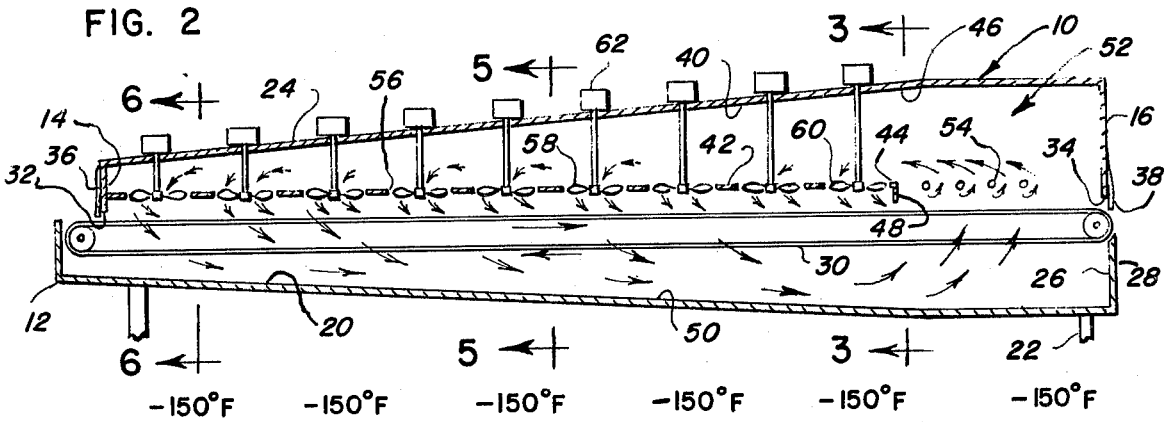
TYPICAL TEMPERATURES

CRYOGENIC FREEZER

BACKGROUND OF THE INVENTION

This invention relates to a method and apparatus for freezing articles with cryogenic liquids, and more particularly, to freezing prepared foods and the like at a substantially constant temperature.

Foods having high water content cannot be satisfactorily frozen with conventional refrigeration systems utilizing freon and other conventional refrigerants. These systems have a relatively slow freezing rate which produces ice crystal growth in fruits and other foods, which ruptures the delicate cell walls and results in collapse of the food upon thawing.

With cryogenic liquids, such as liquid nitrogen, however, freezing rates can be obtained which are so fast that high water content products can be frozen whereby little or no collapse occurs upon thawing. The rate of freezing with liquid nitrogen is so rapid that the food is frozen with little or no loss of flavor. Moreover, since the water content of the frozen perishables is retained, the food is prevented from becoming dehydrated, dry and flakey.

Cryogenic freezers and systems are well known. Liquid nitrogen flash freezing of meat, poultry, seafood, bakery products, citrus fruits, prepared foods and non-food products are disclosed in U.S. Pat. No. 3,494,140. Mass freezing of conveyorized products are described in U.S. Pat. Nos. 3,345,828; 3,376,710; 3,805,538 and 3,393,532; and cryogenic flash tunnels are described in U.S. Pat. Nos. 3,287,932 and 3,871,185. U.S. Pat. Nos. 3,403,527 and 3,879,954 describe countercurrent vapor recirculation flash freezing and U.S. Pat. No. 3,238,736 illustrates a manifold for ejecting liquid nitrogen in proximity to the outlet of a flash tunnel. These are typical of disclosures of liquid nitrogen freezing apparatus. In conventional cryogenic freezers, such as those described above, the nitrogen propelled against the articles to be frozen varies in temperature along the length of the freezer.

SUMMARY OF THE INVENTION

In accordance with the present invention, an isothermal freezer is provided for flash freezing comestible material at a substantially uniform temperature. The freezer includes a cryogenic flash freezing tunnel having longitudinally spaced ends, one of which defines an inlet and the other of which defines an outlet for the ingress and egress of conveyorized comestible material. Conveyor means are provided for conveying comestible material from the inlet to the outlet and through the tunnel. Elongated duct means overlie and are spaced from the conveyor means and extend along an upper portion of the tunnel. The duct means define a plurality of longitudinally spaced outlet apertures generally facing the conveyor means and defining a fluid-flow inlet passageway spaced disposed intermediate the ends of the tunnel. Nozzle means are spaced in the tunnel between the fluid-flow inlet passageway and one of the ends for discharging cryogenic liquid into a conditioning zone in the tunnel where cryogenic gas is conditioned and chilled by the vaporized cryogenic liquid. Fan means are positioned generally in vertical alignment with the outlet apertures for conveying the conditioned and chilled cryogenic gas through the duct means and through the outlet apertures and downwardly against the conveyorized comestible material, so that the conveyorized comestible material is blanketed with the conditioned and chilled cryogenic gas which is at a substantially uniform temperature along the length of the duct means.

In the illustrative embodiment, the duct means comprises a generally flat base which defines the outlet apertures and substantially spans the width of the tunnel. The duct means may also include a downwardly-depending baffle adjacent the fluid-flow inlet passageway for substantially preventing backflow of cryogenic gas between the conveyor means and the base.

In a preferred embodiment of the invention, the cross-sectional area of the duct means decreases progressively from the fluid-flow inlet passageway towads the end of the flash tunnel remote from the nozzle means, and the return zone is of increasing cross-sectional area from said remote end of the tunnel toward the conditioning zone.

The fan means preferably comprises propellers mounted for rotation in the outlet apertures and are preferably disposed in substantially coplanar relationship with the outlet apertures of the base. Each propeller circumscribes an area slightly less than the area defined by each of the outlet apertures.

One method of cryogenically freezing comestible material includes providing a cryogenic flash tunnel having longitudinally spaced ends defining an inlet and an outlet; conveying the comestible material on a conveyor through the cryogenic flash tunnel from the inlet to the outlet; providing duct means in the tunnel for conveying cryogenic gas at a substantially uniform temperature from the conditioning zone nearby the one of the ends of the tunnel toward the other of the ends of the tunnel; introducing liquified cryogenic gas into the conditioning zone and permitting the liquified gas to vaporize; conveying the conditioned cryogenic gas at a substantially uniform temperature through the duct means and downwardly through a plurality of apertures in the duct means against the comestible material so that the cryogenic gas contacts the comestible material substantially along the length of the duct and at a substantially uniform temperature; returning the spent cryogenic gas at an elevated temperature to the conditioning zone through a return zone; introducing further liquified cryogenic gas into the conditioning zone to condition and chill the spent gas to a temperature substantially equal to the uniform temperature in the duct means; and then again, conveying the chilled and conditioned gas through the duct means.

A more detailed explanation of the invention is provided in the following description and appended claims taken in conjunction with the accompanying drawings.

cl BRIEF DESCRIPTION OF THE DRAWINGS

FIG. 1 is a diagrammatic longitudinal cross-sectional view of a prior art cryogenic freezer;

FIG. 2 is a diagrammatic view in longitudinal cross-section of a cryogenic freezer in accordance with principles of the present invention;

FIG. 7 is an enlarged fragmentary perspective view of a modified embodiment of a cryogenic freezer in accordance with principles of the present invention.

DETAILED DESCRIPTION OF THE ILLUSTRATIVE EMBODIMENT

Figure 3:
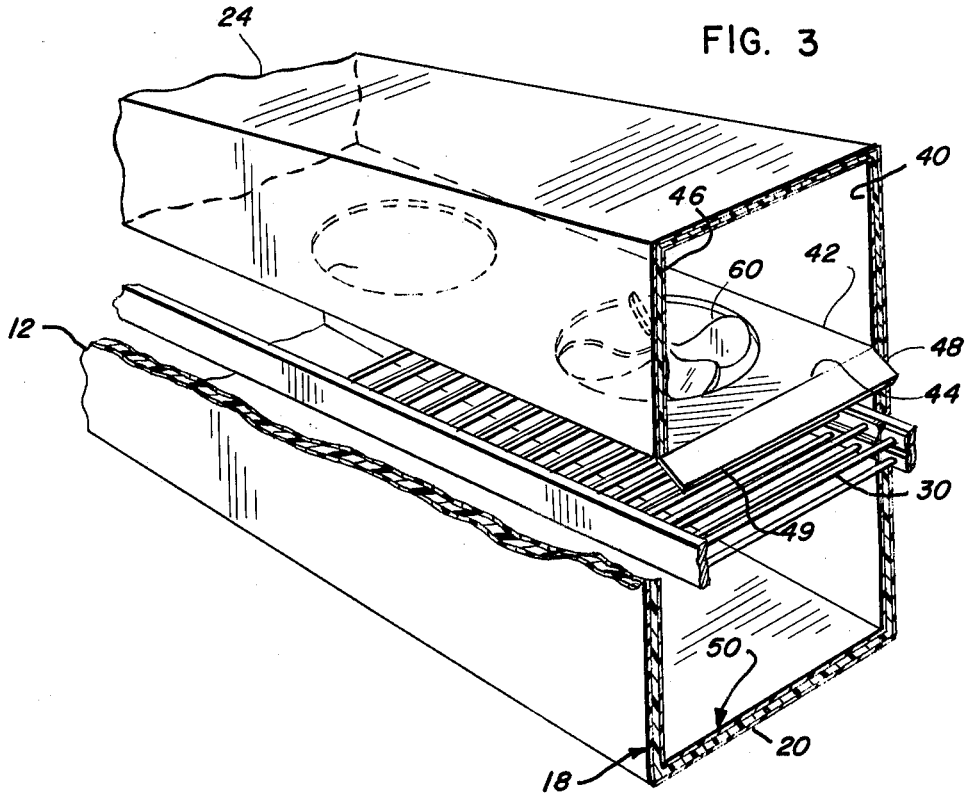
FIG. 3 is an enlarged fragmentary perspective view of portions of the cryogenic freezer viewed substantially from line 3—3 of FIG. 2 and illustrating the cross-sectional configuration of the duct means and the return zone.
Figure 4:
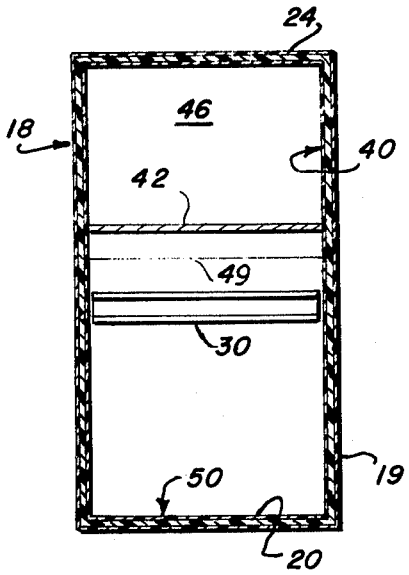
FIG. 4 is a cross-sectional end view of the cryogenic freezer taken substantially along line 3—3 of FIG. 2.
Figure 5:
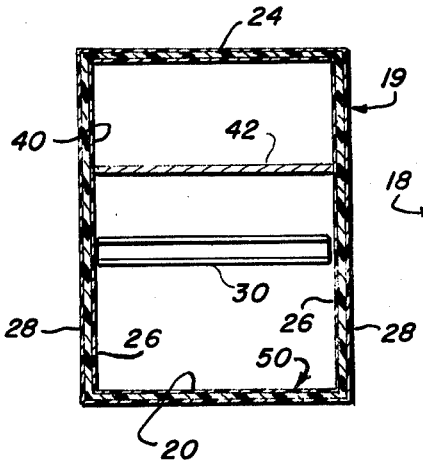
FIG. 5 is a cross-sectional end view of the cryogenic freezer taken substantially along line 5—5 of FIG. 2.
Figure 6:
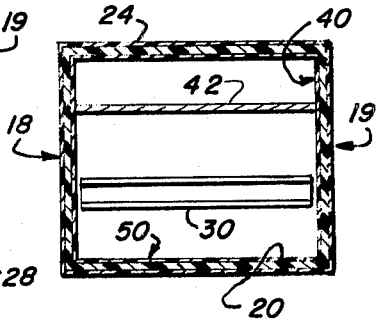
FIG. 6 is a cross-sectional end view of the cryogenic freezer taken substantially along line 6—6 of FIG. 2.

Referring now to FIGS. 2–6, inclusive, an isothermal cryogenic freezer in accordance with a presently preferred embodiment of this invention is indicated generally by 10. Freezer 10 includes an elongated cryogenic flash freezing chamber or tunnel 12, which is preferably of a box-like or rectangular cross-sectional configuration with longitudinally spaced ends or end walls 14 and 16, elongated sidewalls 18 and 19, a generally planar interior bottom or floor 20 sloping downward toward an outlet drain 22 and a generally planar interior cover or ceiling member 24. To provide access to the interior of the tunnel, the ceiling 24 may be pivotally hinged in sections to sidewall 18. Preferably, the ceiling is inclined downwardly towards the inlet end of the tunnel. The interior portions 26 of the tunnel walls 18 and 19 are preferably formed of or lined with stainless steel. To assist in insulating the tunnel from the ambient atmosphere, an exterior steel wall portion 28 may be provided and suitable insulating material, such as polyurethane foam, may be sandwiched between wall portions 26 and 28.

A suitable conveyor means, such as a generally horizontally positioned endless conveyor 30 is disposed within the tunnel. The conveyor may be power driven in any conventional manner and is of a foraminous type, such as wire-mesh or spaced cross-bars. Preferably, the conveyor extends outwardly of the tunnel at each end so that comestible material to be frozen in the tunnel may be disposed on the conveyor at an inlet end of the tunnel and may be carried and conveyed through the tunnel and outwardly of the outlet end of the tunnel for further processing. The linear speed of the conveyor will depend upon the conveyor size, the size of the product and the number of articles desired to be conveyed. For hamburger patties, generally two to three minutes exposure in the tunnel will be enough. For breaded chicken, 8 or 9 minutes may be necessary.

End wall 14 defines an inlet 32 which is desirably rectangular in shape and the opposite end wall 16 defines an outlet 34 which is also desirably rectangular in shape. The inlet and outlet are provided with flexible sealing flaps or curtains 36 and 38, respectively, of thermally insulating plastic material, such as Mylar. Although the inlet and outlet ends cannot be totally sealed, the flexible curtains do tend to minimize loss of cryogenic gas from the tunnel. Curtains 36 and 38 are suitably mounted to end walls 14 and 16 adjacent the inlet and outlet, respectively, and are shaped to permit the passage of the conveyorized material into and out of the tunnel without substantial interference.

An elongated duct means such as elongated duct 40, is provided within the tunnel as will best be seen in FIGS. 2 and 3. The duct is spaced above and overlies the conveyor 30. In the illustrative embodiment, the duct extends for a majority of the length of the tunnel, from adjacent the inlet 32 towards the outlet 34. In the illustrative embodiment, duct 40 comprises a portion of ceiling 24, upper interior portions 26 of sidewalls 18 and 19 and a generally flat elongated baffle, deflector plate or base portion 42 preferably positioned in parallel relationship to the conveyor. Baffle or base portion 42 is preferably of plate-like sheet metal, such as stainless steel. The baffle is secured to the sidewalls 18 and 19 to span the width of the tunnel 12 and securely extends from the inlet end wall 14 to longitudinally terminate in an unattached or free end 44 spaced from the outlet end wall 16. The baffle or base portion 42 may be removably secured to the sidewalls for ease of cleaning and the like. A fluid-flow inlet passageway 46 is defined by the duct means adjacent the free end to provide an entrance into the duct for cryogenic gas.

Supplemental baffle means, such as a downwardly-depending outwardly-inclined baffle member 48 is provided. The lowermost edge 49 of the supplemental baffle member is positioned immediately above the conveyor, but far enough above so that material carried on the conveyor will not be contacted thereby. The supplemental baffle member assists in directing the cryogenic gas into and through the duct means.

As will be seen from FIGS. 3–6, the duct means is preferably of a rectangular cross-sectional configuration which decreases progressively from adjacent the fluid-flow inlet passageway or entrance toward the inlet end of the tunnel.

The space between the underside of the conveyor and the floor 20 generally defines a return zone 50 for return passage of spent cryogenic gas, which has passed downward through the conveyor and/or contacted the comestible material on the conveyor. Because the comestible material is generally warmer adjacent the inlet end of the tunnel than near the outlet end of the tunnel and consequently gives off more heat near the inlet end than near the outlet end as the comestible material continuously is blanketed with cryogenic gas, the spent gas adjacent the inlet end is somewhat warmer than the spent gas near the outlet end and the temperature gradient between the cryogenic gas and the conveyorized material is greater at the inlet end than at the outlet end. The cross-sectional configuration of the return zone below the conveyor is also substantially rectangular and increases progressively from the inlet end of the tunnel towards the outlet end of the tunnel.

Cryogenic gas is introduced into the tunnel 12 at a conditioning zone 52 above the conveyor and intermediate the fluid-flow inlet passageway 46 of the duct and the outlet 34 of the tunnel. The cryogenic gas is preferably introduced by suitable nozzle means such as a plurality of ejector nozzles 54. The ejector nozzle sprays cryogenic liquid into the tunnel, which substantially vaporizes to cryogenic gas upon being discharged from the nozzles into the interior environment of the tunnel, so as to substantially avoid contacting the comestible material with cryogenic liquid. A suitable source of supply (not shown) of liquified volatile cryogenic gas such as liquified nitrogen, is provided and is suitably connected to the ejector nozzles.

In the preferred embodiment, the ejector nozzles 54 define spray headers which are suitably remotely controllable by valves which may be electrically operated or which, when desired, may be an air operated modulating type for selectively regulating the discharge rate of cryogenic liquid into the conditioning zone. The control valves are preferably responsive to suitable temperature sensing means, such as thermocouples, which are suitably mounted and positioned within the tunnel to measure temperatures at preselected locations within the tunnel.

In the conditioning zone 52, the freshly discharged cryogenic gas mixes with and chills spent cryogenic gas, which has passed downward through the conveyor and/or contacted the comestible material on the conveyor and has passed through the return zone 50. The temperature of spent cryogenic gas typically is warmer than the freshly discharged cryogenic gas as a result of contacting the comestible material to be frozen and extracting heat therefrom. The chilled mixture of freshly discharged cryogenic gas and spent cryogenic gas, generally defines conditioned cryogenic gas, which is then conveyed from the conditioning zone through the duct 40.

To provide for conveying and circulation of the cryogenic gas through the tunnel in accordance with this invention, the duct 40 provides and defines a suitable plurality of longitudinally spaced outlet apertures 56 generally facing the conveyor through which cryogenic gas is propelled downwardly against the conveyor and the comestible material carried thereon. In the preferred embodiment, the baffle or base portion 42 of the duct defines the plurality of outlet apertures 56. The outlet apertures are preferably spaced at generally equal intervals along the duct from the fluid-flow inlet passageway to the inlet end of the tunnel and are preferably positioned in longitudinal alignment. In the illustrative embodiment, the apertures are of the same size to discharge equal amounts of cryogenic gas upon the comestible material.

In each of the outlet apertures 56, a suitable fan or blower means, such as a propeller 58 is positioned. Each propeller 58 includes a plurality of propeller-like blades 60 mounted for rotation in the aperture. The blades are substantially disposed in coplanar relationship with the outlet apertures and with the baffle or base 42. Each propeller preferably circumscribes an area slightly less than the area defined by its associated outlet aperture. The fans are powered by suitable motors 62 seated upon the ceiling 24 and mounted externally of the tunnel 12. The fan or blower means serves to convey: (1) conditioned gas from the conditioning zone through the duct means, (2) conditioned gas from the duct means through the outlet apertures 56 and onto the comestible material to blanket, impinge, envelop and flash freeze the comestible material, (3) gas about the comestible material through the conveyor means and into the return zone, and (4) spent gas from the return zone to the conditioning zone.

The cryogenic gas is generally conveyed in a circular or elliptical flow pattern generally opposite the directional movement of the conveyor. For example, conditioned gas flowing through the duct is opposite the feed direction of the conveyor, while the gas flowing beneath the conveyor in the return zone 50 toward the conditioning zone 52 is opposite the return direction of the conveyor. When the conveyor moves in a clockwise direction, the gas moves in a counterclockwise direction. Furthermore, the overall flow pattern of the gas flowing through the outlet apertures of the duct and through the foraminous conveyor into the return zone is generally turbulent and in the same general direction as the circular or elliptical flow pattern of the main body of cryogenic gas.

In some situations it is desirable that the cryogenic gas be conveyed in the same general direction as the comestible material carried by the conveyor to provide generally parallel flow of the cryogenic gas and the comestible material. This may simply be accomplished in the embodiment of FIG. 2, by reversing the direction of the conveyor. In this situation the end defining opening 34 of the tunnel 12 becomes the inlet end and the end defining opening 3 of the tunnel becomes the outlet end so that comestible material to be frozen is fed through the tunnel from the inlet opening 34 to the outlet opening 32. Thus, for parallel flow the flow pattern of the cryogenic gas remains as illustrated by the arrows of FIG. 2 with only the directional arrows of the conveyor being reversed. In this situation, the conditioning zone, while remaining physically the same, becomes redefined as being located intermediate the inlet opening 34 and the fluid-flow inlet passageway 46 of the duct.

Although propellers are the preferred blower or fan means, other types of fans and blowers may be used. However, care should be taken to avoid the use of those fans which tend to promote ice-crystal growth thereon which would, of course, interfere with the cryogenic gas circulated and which would, therefore, decrease the overall efficiency of the system.

The cryogenic gas is drawn from the conditioning zone into the duct means by the fan means. The longitudinal baffle or base 42 serves to baffle the conditioned gas and to block or restrict its discharge onto the comestible material to be frozen, except through the outlet apertures 56.

The use of the baffle 42 and duct means serves to maintain the temperature of the cryogenic gas discharged against the comestible material along the length of the duct at a substantially uniform temperature, so that the temperature in the duct is maintained at substantially uniform level throughout the length of the duct and the temperature of the cryogenic gas contacting the comestible material is maintained at a substantially uniform temperature along the length of the duct. This is thereby contrasted to the conventional practice of the art, as shown in FIG. 1, in which there are substantial differences in the temperature of the cryogenic gas along the length of the cryogenic tunnel, such as a range of from about −20° F. to about −200° F.

One of the advantages to be achieved by maintaining a substantially uniform temperature along most of the length of a cryogenic freezer is that comestible material can be quickly frozen immediately upon entering the tunnel, because the inlet temperature is generally the same as the temperature along the freezer in contrast to prior art freezers where typically the inlet temperature is considerably warmer than other parts of the freezer. This is particularly useful with a product such as frozen pre-breaded chicken, where it is important that the batter-breading coating be frozen as rapidly as possible after it is applied to the marinated chicken pieces. Another advantage is that this arrangement generally provides for uniform freezing of the comestible material.

The cross-sectional area of both the return zone and the duct at various positions along the length of the tunnel is proportioned so that the velocity of the cryogenic gas remains substantially uniform along the duct and substantially uniform along the return zone. This provides a substantially uniform volume of cryogenic gas along the length of the duct for enveloping the material to be frozen.

With the baffle and duct area as illustrated in FIG. 2, it will be seen that substantially all of the conditioned cryogenic gas is carried through the duct for downward discharge. The supplemental baffle means 48 tends to baffle or restrict back-flow of conditioned gas from the conditioning zone toward the inlet via the space between the duct means and the conveyor means and assists in directing and deflecting the flow of gas into the fluid inlet passageway of the duct. The base 42 of the duct 40 and the supplemental baffle each further tends to minimize eddy currents and tends to maintain spent gas in its position below the upper flight of the conveyor and within the return zone thereby to maximize the freezing efficiency of the isothermal freezer of this invention.

After the freezer reaches its operating temperature and has reached a condition of substantial equilibrium, assuming a substantial uniform quantity of comestible material being introduced per unit time, the quantity of cryogenic liquid introduced should drop to a relatively constant amount. It will be necessary continuously to introduce some cryogenic liquid to compensate for gas losses, including losses through the inlet and outlet and for the heat extracted from the comestible material.

The temperature level of the cryogenic gas circulated through the duct may be selected according to the quantity and type of product to be frozen. For example, for pre-breaded chicken, it has been determined that a temperature of approximately −150° F. is suitable for impinging and blanketing the chicken. In accordance with this invention, the chicken will be contacted with gas of this temperature substantially throughout the length of the duct. A period of eight to nine minutes will be adequately suitable to freeze a pre-breaded chicken at this temperature.

Referring now to FIG. 7, a pilot unit 110 defining a modified embodiment of the isothermal freezer, has been constructed and operated in accordance with the method of this invention. The structure and individual components of the pilot unit are substantially similar to the structure and components of the isothermal freezer shown in FIGS. 2–6. For sake of convenience, similar parts have been numbered similarly, but with numbers in a one-hundred series. For example, end walls 16 and 116 are similarly numbered, as are conveyor means 30 and 130, conditioning zone 52 and 152, and so forth. Because the pilot unit was of reduced scale, it was not necessary to taper either the ceiling 124 or the floor 120 to practice the method of this invention, so that in the pilot unit, the cross-sectional size of both the duct means 140 and the return zone 150 are each generally uniform along their respective lengths. While supplemental baffle means, such as downwardly-depending baffle member 148, was not utilized in the pilot unit, as tested in the laboratory, the pilot unit can also include such a supplemental baffle.

The interior of the pilot unit is 15 inches wide and 72 inches long. The fans 158 extend from adjacent the inlet 132 of the tunnel 112 for about two-thirds the length of the tunnel, with the nozzles 154 generally occupying the remainder one-third length of the tunnel adjacent the outlet 134. The motor units 162 of the fans are thermally-insulated and mounted from an elongated metal truss 163 of inverted U-shaped configuration, overlying and fixedly attached to the top surface of the longitudinal baffle or base portion 142 within the interior of the duct means. The propeller-like fan blades 160 are rotatably positioned within the outlet apertures 156 and rotatably circumscribe an area of about 12 inches in diameter. The walls of the pilot unit are all insulated with four inch thick polyurethane foam. The interior of the pilot unit was tested as low as −210° F. and with pre-cooked chicken at about −175° F. and found to satisfactorily operate in accordance with the method of this invention.

Although specific embodiments have been shown and described, it should be understood by those skilled in the art that various modifications and substitutions can be made without departing from the novel spirit and scope of this invention.

What is claimed and desired to be secured by Letters Patent of the United States is:

1. An isothermal freezer, comprising:

an elongated cryogenic flash freezing tunnel having longitudinally spaced ends, one of which defines an inlet and the other which defines an outlet for the ingress and egress of conveyorized comestible material;

conveyor means for conveying comestible material from said inlet to said outlet and through said tunnel;

elongated duct means overlying and spaced from said conveyor means and extending along an upper portion of said tunnel, said duct means including portions defining a plurality of longitudinally spaced outlet apertures generally facing said conveyor means and defining a fluid-flow inlet passageway spaced away from and disposed intermediate said ends;

nozzle means longitudinally spaced from said elongated duct means in said tunnel adjacent and between said fluid-flow inlet passageway and one of said ends for discharging cryogenic liquid into a conditioning zone in said tunnel in which zone heated cryogenic gas is conditioned and chilled by vaporized cryogenic liquid;

fan means positioned in generally vertical alignment with said outlet apertures for conveying said conditioned and chilled cryogenic gas through said duct means and through said outlet apertures and downwardly against said conveyorized comestible material, so that said conveyorized comestible material is blanketed with said conditioned chilled cryogenic gas which is at a substantially uniform temperature along the length of said duct means.

2. An isothermal freezer in accordance with claim 1 wherein said duct means portions include a generally flat base defining said outlet apertures and substantially spanning the width of said tunnel.

3. An isothermal freezer in accordance with claim 2 wherein the duct means further includes a downwardly-depending baffle adjacent the fluid-flow inlet passageway for substantially preventing back-flow of cryogenic gas between the conveyor means and said base.

4. An isothermal freezer in accordance with claim 2 wherein said fan means comprise propellers mounted for rotation in said outlet apertures and being disposed in substantially coplanar relationship with the outlet apertures in said base.

5. An isothermal freezer in accordance with claim 4 wherein each propeller circumscribes an area slightly less than the area defined by each of the outlet apertures.

6. An isothermal freezer in accordance with claim 1 wherein the cross-sectional area of said duct means decreases progressively from said fluid-flow inlet passageway towards the end of said flash tunnel remote from said nozzle means.

7. An isothermal freezer in accordance with claim 6 wherein the cross-sectional configuration of said duct means along its length is rectangular.

8. An isothermal freezer in accordance with claim 1 wherein said outlet apertures are longitudinally and substantially uniformly spaced from each other.

9. An isothermal freezer in accordance with claim 1 wherein said conveyor means is formanious whereby cryogenic gas may pass therethrough, and wherein there is a return zone below said conveyor means for returning spent cryogenic gas toward said nozzle means and to said conditioning zone.

10. An isothermal freezer in accordance with claim 9 wherein said return zone is of increasing cross-sectional area from the inlet of said tunnel towards said conditioning zone.

11. An isothermal freezer in accordance with claim 1 wherein said tunnel is generally rectangular in cross-section and has a generally planar ceiling and a generally planar floor, and in which said ceiling and said floor each converge toward said conveyor means in the direction of said inlet.

12. An isothermal freezer in accordance with claim 1 wherein said fan means comprise propellers mounted for rotation in the outlet apertures.

13. An isothermal freezer in accordance with claim 1 further including means thermally sealing the inlet and outlet without substantially interfering with the conveyorized passage of comestible material through the tunnel, said means including a first flexible flap of thermally insulating plastic mounted on said tunnel adjacent the inlet and a second flexible flap of thermally insulating plastic mounted on said tunnel adjacent the outlet.

14. An isothermal freezer in accordance with claim 1 wherein the length of said duct means is in excess of at least half the interior length of said tunnel.

15. An isothermal freezer, comprising:

a cryogenic flash freezing tunnel having a planar interior ceiling, a planar interior floor, elongated side walls connecting said ceiling to said floor, and spaced end walls connecting said side walls with one of said end walls defining an inlet for the ingress of conveyorized comestible material into the tunnel and the other of said end walls defining an outlet for the egress of conveyorized comestible material out of said tunnel;

a foraminous conveyor for conveying comestible materials through the tunnel from said inlet to said outlet;

an elongated sheet-like member overlying and spaced above said foraminous conveyor, the elongated member lying generally in parallel relationship to said conveyor, said elongated sheet-like member secured to the side walls so as to span the width of said tunnel and extending towards said outlet from an end wall adjacent the inlet, the elongated sheet-like member including an unattached free end spaced from the outlet and defining a plurality of longitudinally spaced outlet apertures generally facing the foraminous conveyor, said elongated member structurally cooperating with the ceiling and upper portions of the side walls to define an elongated duct for countercurrent flow of cryogenic gas generally in a direction opposite to the direction of movement of said conveyor and defining a fluid-flow inlet passageway adjacent said unattached free end;

a plurality of nozzles longitudinally spaced from said elongated duct in the tunnel adjacent and between said fluid-flow inlet passageway and said outlet for discharging cryogenic liquid into a conditioning zone in said tunnel, said liquid vaporizing to cryogenic gas upon being discharged into said tunnel; and fan means including a plurality of power-driven propeller-like blades rotatably positioned in each of said outlet apertures for conveying the cryogenic gas through said duct and through said outlet apertures and downwardly against said conveyorized comestible material to blanket said conveyorized comestible material at a substantially constant temperature along the length of the duct, said fan means further conveying the cryogenic gas through said foraminous conveyor into a return zone beneath said conveyor and through said return zone generally in the direction of movement of said conveyor toward said nozzles and for introduction into said conditioning zone.

16. An isothermal freezer, comprising:

a cyrogenic flash freezing tunnel having a planar interior ceiling, a planar interior floor, elongated side walls connecting said ceiling to said floor, and spaced end walls connecting said side walls with one of said end walls defining an inlet for the ingress of conveyorized comestible material into the tunnel and the other of said end walls defining an outlet for the egress of conveyorized comestible material out of said tunnel;

a foraminous conveyor for conveying comestible materials through the tunnel from said inlet to said outlet;

an elongated sheet-like member overlying and spaced above said foraminous conveyor, the elongated member lying generally in parallel relationship to said conveyor, said elongated sheet-like member secured to the side walls so as to span the width of said tunnel and extending towards said inlet from an end wall adjacent the outlet, the elongated sheet-like member including an unattached free end spaced from the inlet and defining a plurality of longitudinally spaced outlet apertures generally facing the foraminous conveyor, said elongated member structurally cooperating with the ceiling and upper portions of the side walls to define an elongated duct for parallel flow of cryogenic gas generally in the direction of movement of said conveyor and defining a fluid-flow inlet passageway adjacent said unattached free end;

a plurality of nozzles spaced in the tunnel between said fluid-flow inlet passageway and said inlet for discharging cryogenic liquid into a conditioning zone in said tunnel, said liquid vaporizing to cryogenic gas upon being discharged into said tunnel; and fan means including a plurality of power-driven propeller-like blades rotatably positioned in each of said outlet apertures for conveying the cryogenic gas through said duct and through said outlet apertures and downwardly against said conveyorized comestible material to blanket said conveyorized comestible material at a substantially constant temperature along the length of the duct, said fan means further conveying the cryogenic gas through said foraminous conveyor into a return zone beneath said conveyor and through said return zone generally opposite the direction of movement of said comestible materials toward said nozzles and for introduction into said conditioning zone.

17. A method of cryogenically freezing comestible material comprising the steps of:

providing a cryogenic flash freezing tunnel having longitudinally spaced ends, one of which defines an inlet and the other of which defines an outlet;

conveying comestible material on a conveyor through said cryogenic flash tunnel from said inlet to said outlet;

providing duct means in said tunnel for conveying cryogenic gas at a substantially uniform temperature from a conditioning zone nearby one of said ends of said tunnel towards the other of said ends of said tunnel;

introducing liquified cryogenic gas into said conditioning zone and permitting the liquified gas to vaporize;

conveying conditioned cryogenic gas at a substantially uniform temperature through said duct means downwardly through a plurality of apertures in said duct means against said comestible material so that the cryogenic gas contacts said comestible material substantially along the length of said duct and at a substantially uniform temperature;

returning the spent cryogenic gas at an elevated temperature to said conditioning zone through a return zone;

introducing further liquified cryogenic gas into said conditioning zone to condition and to chill said spent gas to a temperature substantially equal to the said uniform temperature in said duct means; and then again conveying said chilled and conditioned gas through said duct means.

18. A method in accordance with claim 17 in which said conveyor is foraminous and said gas passes through the conveyor into said return zone.

19. A method in accordance with claim 17 wherein said duct means is shaped to provide a diminishing cross-sectional area generally decreasing along the length of said duct means towards one of said ends of said tunnel and said step of conveying further includes conveying the cryogenic gas at a substantially constant flow rate along the length of said duct means.

20. A method in accordance with claim 19 wherein said return zone is shaped to provide a progressively increasing cross-sectional area along the length of the duct means towards the second of said ends of said tunnel and said step of returning further includes returning the spent cryogenic gas at a substantially constant flow rate along the length of said return zone.

21. A method in accordance with claim 17 wherein the comestible material is conveyed in a direction opposite to the direction in which the cryogenic gas is conveyed through said duct means.

22. A method in accordance with claim 17 wherein the comestible material is conveyed in the same direction in which the cryogenic gas is conveyed through said duct means.

* * * * *